US007311110B2

(12) United States Patent
Wu

(10) Patent No.: US 7,311,110 B2
(45) Date of Patent: Dec. 25, 2007

(54) AUTOMATIC CLOSE UMBRELLA WITH AUTOMATIC RESETTING FEATURE

(76) Inventor: Michael Wu, P.O. Box 166-13, Taipei (TW) 115

( * ) Notice: Subject to any disclaimer, the term of this patent is extended or adjusted under 35 U.S.C. 154(b) by 263 days.

(21) Appl. No.: 11/074,185

(22) Filed: Mar. 8, 2005

(65) Prior Publication Data

US 2006/0201543 A1 Sep. 14, 2006

(51) Int. Cl.
*A25B 25/14* (2006.01)

(52) U.S. Cl. ..... 135/24; 135/25.1; 135/40; 135/28

(58) Field of Classification Search ..... 135/22, 135/24, 25.1, 20.3, 37, 40, 75, 28, 25.4, 20.1; 248/155.8; 403/378, 379.1, 379.2, 110, 109.1, 403/109.2, 324, 329
See application file for complete search history.

(56) References Cited

U.S. PATENT DOCUMENTS 4,329,078 A * 5/1982 Crates et al. ..... 403/316
4,986,294 A * 1/1991 Wu ..... 135/22
5,144,970 A * 9/1992 Seidel et al. ..... 135/22
5,297,571 A * 3/1994 Chu et al. ..... 135/24
5,309,932 A * 5/1994 Chou et al. ..... 135/22
5,740,823 A * 4/1998 Lin et al. ..... 135/24
6,286,529 B1 * 9/2001 Olivera ..... 135/82
6,341,613 B1 * 1/2002 Wu et al. ..... 135/24
6,626,197 B2 * 9/2003 Lin et al. ..... 135/24
6,810,894 B2 * 11/2004 Chen ..... 135/22

FOREIGN PATENT DOCUMENTS

GB 2322799 A * 9/1998
JP 2004121328 A * 4/2004

* cited by examiner

*Primary Examiner*—Winnie Yip

(57) ABSTRACT

An automatic close umbrella is disclosed. As folding an umbrella, the user presses a control device on a handle by one finger so that a tenon is released from a buckle and thus the buckle unit of the lower rib collector is separated from the lower central pole. Furthermore, the lower rib collector descends due to the elasticity of a first elastomer disposed between the upper rib collector and lower rib collector further addition of impacting the hook device of the central pole. Thereby, two central poles are separated from each other and the hook device of each central pole will be released. Therefore, each multi-section central pole is telescopic automatically. Furthermore, as the hinged ribs are folded, the canopy arranged on the hinged ribs will be closed. Thus, as the user enters into a room or a car, the user may close the umbrella easily by only one hand.

6 Claims, 10 Drawing Sheets

AUTOMATIC CLOSE UMBRELLA WITH AUTOMATIC RESETTING FEATURE

BACKGROUND OF THE INVENTION

1. Field of the Invention

The present invention relates to umbrellas, and particularly to a fully automatic closing umbrella which includes functions of automatically closing an umbrella canopy and automatically retracting and resetting a telescopic shaft as a button is pushed.

2. Description of Related Art

Conventional umbrellas are opened and closed manually by both hands. The canopy on the umbrella is pushed up for opening and pulled down for closing the umbrella. Both manual actions require the use of both hands. To open an umbrella, one hand pushes the canopy upward while the other hand securely holds the handle for leverage. To close an umbrella, a user pulls down the canopy and pulls one end of the umbrella against the other to compress the telescopic shaft together.

The prior automatic opening function allows on umbrella canopy to automatically open by pushing a button with one hand. The shaft is telescopically stretched out and the canopy of the umbrella is opened. However, to close the umbrella, the user still needs to pull one end of the umbrella against the other and compress the telescopic shaft together. This inconvenience poses a problem during rainy days, i.e., when a user is holding an object by one hand. The user must firstly put the object aside and then proceed to close the umbrella with both hands.

Automatic closing function was later developed and incorporated with the automatic opening function. Thus known as the automatic opening and closing function, current automatic closing function automatically closes the canopy and ribs of the umbrella by pushing a button. However, the telescopic shaft remains stretched and unfolded. To properly close the umbrella and fold the telescopic shaft, the user still needs to pull one end of the umbrella against the other and compress the telescopic shaft together. This resets the telescopic shaft and prepares it for use again. Additionally, these prior art designs are complicated in structure and comprise many parts, which can be damaged easily.

SUMMARY OF THE INVENTION

An automatic close umbrella is disclosed. As the umbrella is to be folded, the user only needs to press an elastic control device on a handle by one finger so that a tenon is released from a buckle and thus the buckle unit of the lower rib collector is separated from the lower central pole. Furthermore, the lower rib collector descends due to the elasticity of a first elastomer disposed between the upper rib collector and lower rib collector further addition of impacting the hook device of the central poles. Thereby, two central poles are separated. Then, the hook device of each central pole will release. Therefore, each multi-section central pole is telescopic automatically. Furthermore, as the hinged ribs are folded, then the canopy will be closed. Thus, as the user enters into a room or a car, the user may close the umbrella easily by only one hand.

The various objects and advantages of the present invention will be more readily understood from the following detailed description when read in conjunction with the appended drawing.

DETAILED DESCRIPTION OF THE PREFERRED EMBODIMENTS

Figure 1:
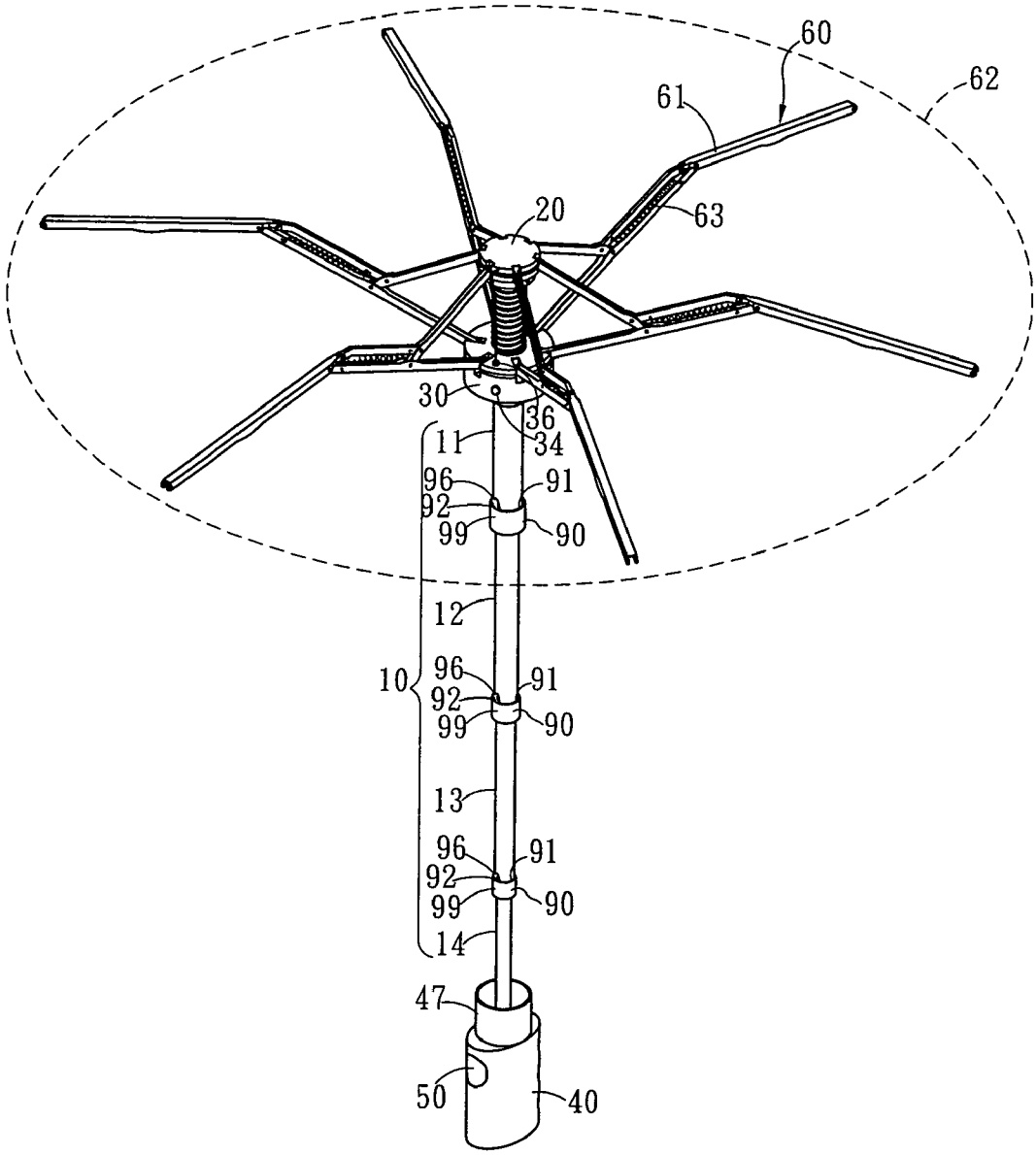
FIG. 1 is a structural view of the umbrella of the present invention.

1. Referring to FIG. 1, an exploded perspective view of the present invention is illustrated. The umbrella has a multi-section telescopic central pole 10, an upper rib collector 20 secured to the top end of the central pole 10, a lower rib collector 30 movable along the telescopic central pole 10, a handle 40 is secured to a lower end of the central pole 10, a control device 50 is disposed on the handle 40 and capable of folding the umbrella, an umbrella stand 60 is formed by a plurality of hinged ribs 61, and a canopy 62 is arranged on the hinged ribs 61 an elastomer 63 may be added between the hinged ribs 61 to improve the descending function of the lower rib collector 30 movable along the central pole 10.

Figure 2:
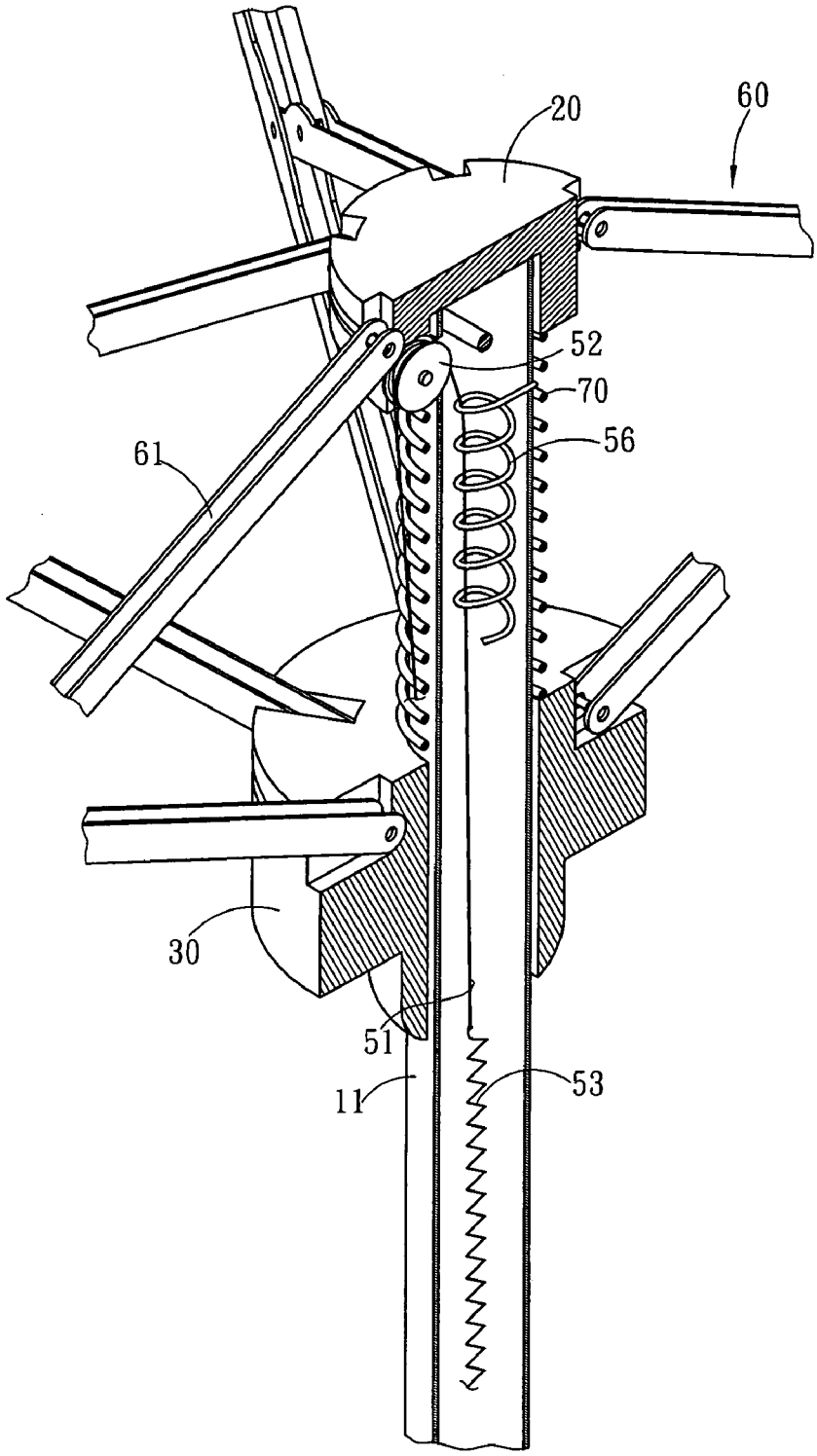
FIG. 2 is a cross section view showing the upper rib collector, the lower rib collector and the upper central pole.

With reference to FIGS. 1 and 2, FIG. 2 is illustrated an enlarged sectional view showing the upper rib collector 20 and lower rib collector 30 of the present invention, a third elastomer 70 (for example, a compressible spring) is disposed between the upper rib collector 20 and lower rib collector 30. After the third elastomer 70 is compressed between the upper, lower rib collectors 20, 30, it has an effect of expansion for restoring to original condition.

Figure 3:
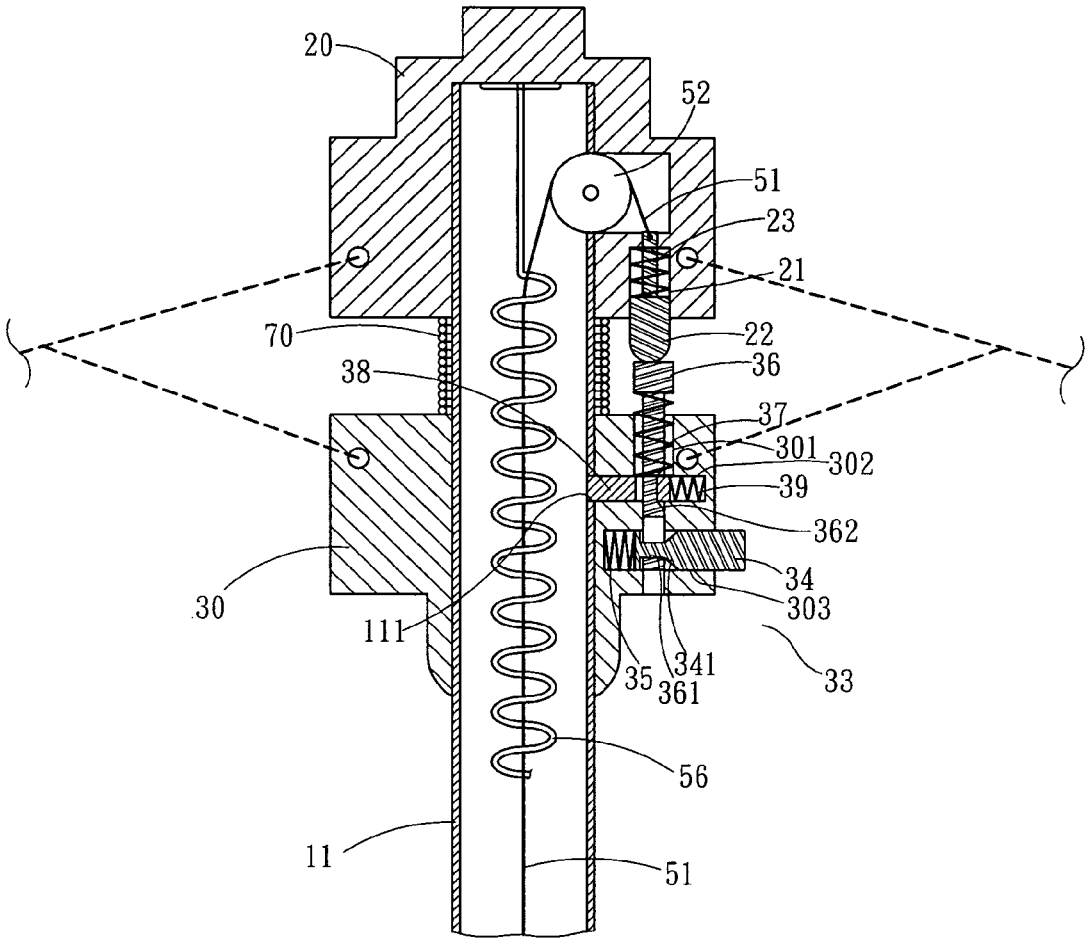
FIG. 3 is a cross section view of the upper rib collector, lower rib collector and upper central pole of FIG. 1, wherein the umbrella has been expanded.

Referring to FIG. 3, the cross section view of the upper rib collector 20 and lower rib collector 30 of the present invention is illustrated. A pulley 52 is installed in the upper rib collector 20. In the present invention, the pulley 52 can be neglected, however, it is preferable to install the pulley. The wire 51 can be led into the upper central pole 11 through the pulley 52. One end of the wire 51 is connected with the key 22. The key 22 may be pushed by the elastomer 23 in the lower rib collector through hole 21. Another end thereof is connected with the tenon 54 in the lower central pole 14 (referring to FIG. 4).

Other than connecting with a plurality of ribs 61, the lower rib collector 30 has a buckle unit 33. The buckle unit 33 includes an inserting bar 36 which vertically passes through the straight through hole 301 in the lower rib collector 30; an elastomer 37 in the straight through hole for elastically moving the inserting bar 36; a positioning pin 38 transversally installed in the lower rib collector transversal hole 302 and operated by an elastomer 39; and a button 34 transversally installed in the lower rib collector transversal hole 303 and operated by an elastomer 35. The inserting bar 36 passes through the positioning pin 38 vertically, and the button 34 passes through the lower end of the inserting bar 36. The rear end of the positioning pin 38 is pushed by the elastomer 39 so that the front end thereof is embedded into the positioning hole 111 of the upper central pole 11. Thereby, the lower rib collector 30 is fit to the upper end of the upper central pole 11. Moreover, the rear end of the button 34 is pushed by the elastomer 35 to protrude out of the transversal hole 303. When the button 34 moves, a stud hole 361 of the inserting bar 36 will be affected by a fillet surface 341 so as to lift upward or descend downward the inserting bar 36. Further, when moving the inserting bar 36, the positioning pin 38 will move transversally due to the action of a bevel surface 362.

Figure 4:
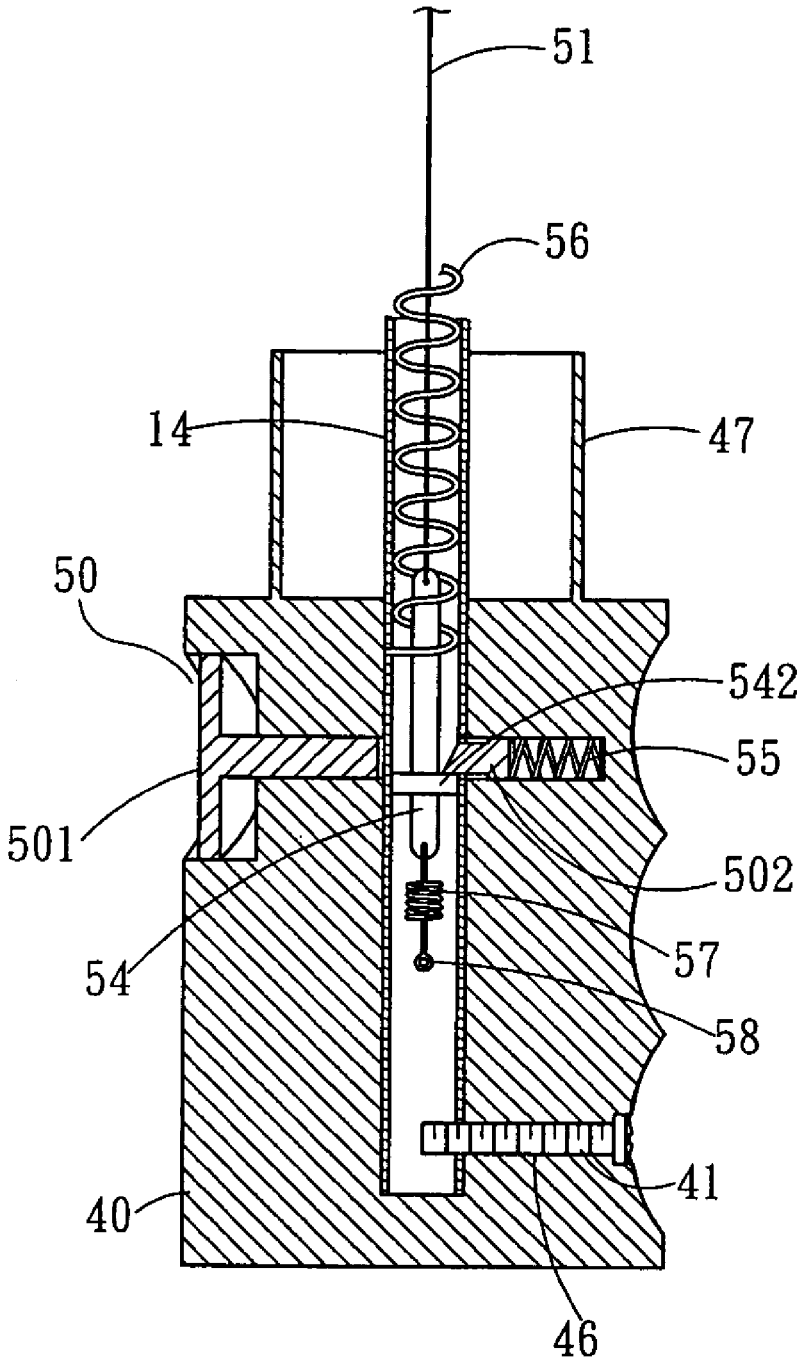
FIG. 4 is a cross section view of the handle of the present invention, wherein the umbrella has been expanded.
Figure 5:
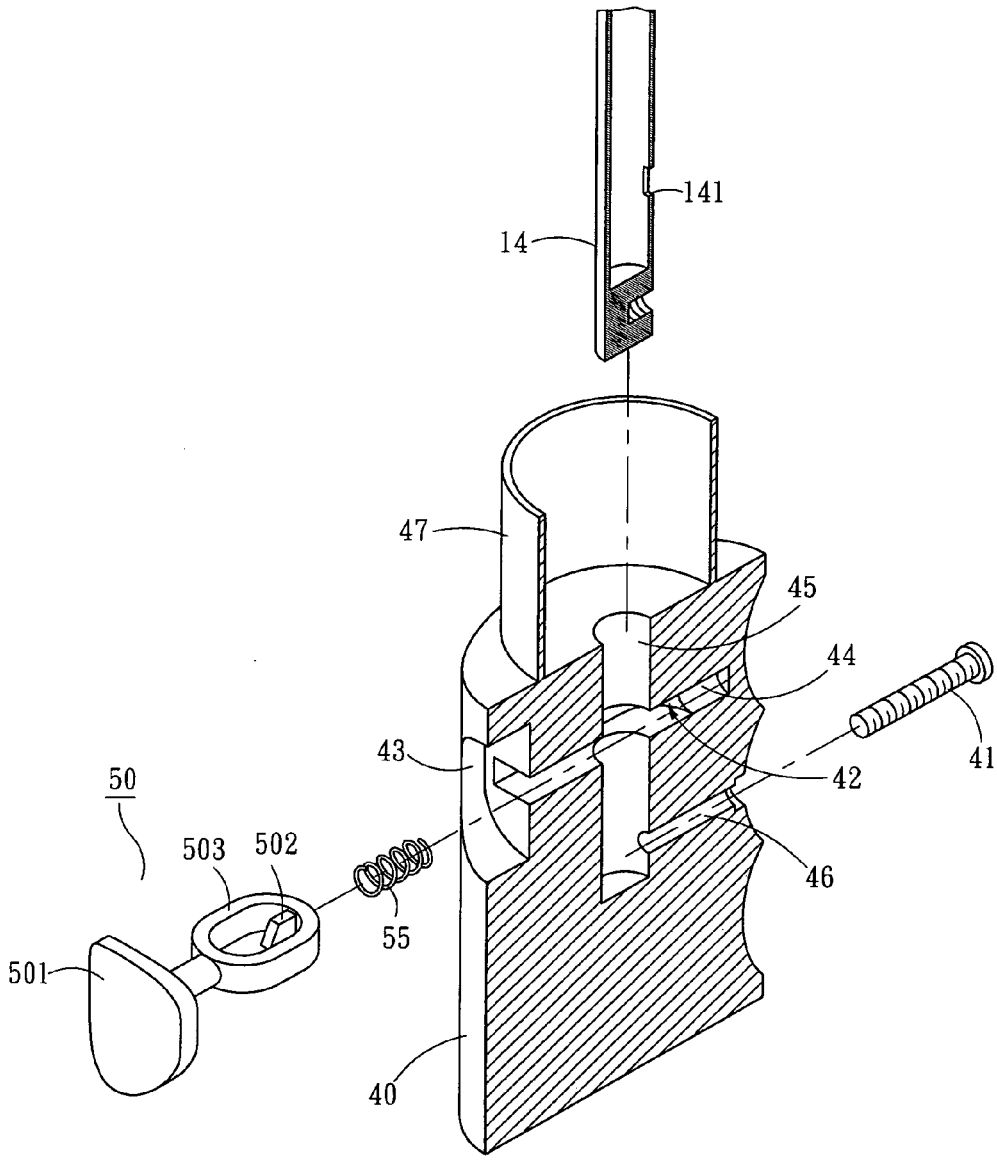
FIG. 5 is an exploded perspective view of the handle and control device of the present invention.

FIG. 4 shows a perspective view of the handle of the umbrella of the present invention. The wire 51, being drawn out from the lower rib collector 30, is connected with the tenon 54 disposed in the lower central pole 14. The lower end of the tenon 54 is connected with a second elastomer 57 (for example a compressible spring). FIG. 4 is exemplified a positioning pin 58 is able to secure the lower end of the second elastomer 57 to the lower central pole 14. The second elastomer 57 pulls the tenon 54 and the wire 51. The tenon 54 has a bulged rim 542 is resisted by a hook 502 which is an integral part of the button 501. And the button 501 also is a part of the control device 50. Referring to FIG. 5, the control device 50 has a girdle 503, a hook 502 is disposed at the rear end inside the girdle 503, and a button 501 is integrally formed with the front end outside the girdle 503. The girdle 503 is disposed at a fillet groove 42 of the handle 40. The button 501 is inlaid and clamped in an inlay groove 43. The rear end of the girdle 503 resists against a coil spring 55 located at a spring groove 44. After the handle central pole 14 passes through the straight hole 45, the through hole 141 at the lower end is parallel and corresponding to the fillet groove 42. Then the hook 502 in the girdle 503 passes through the through hole 141 to resist against the bulged rim 542 of the tenon 54. When the umbrella is opened, the bulged rim 542 is placed below the hook 502 in position. When the button 501 is pressed, the hook 502 will retract so that the tenon 54 lifts automatically due to the shrinkage of the elastomer 23 in the upper rib collector 20 (since the elastic force of the elastomer 23 is larger than that of the second elastomer 57). As a result, the bulged rim 542 of the tenon 54 is placed above the hook 502.

Figure 6:
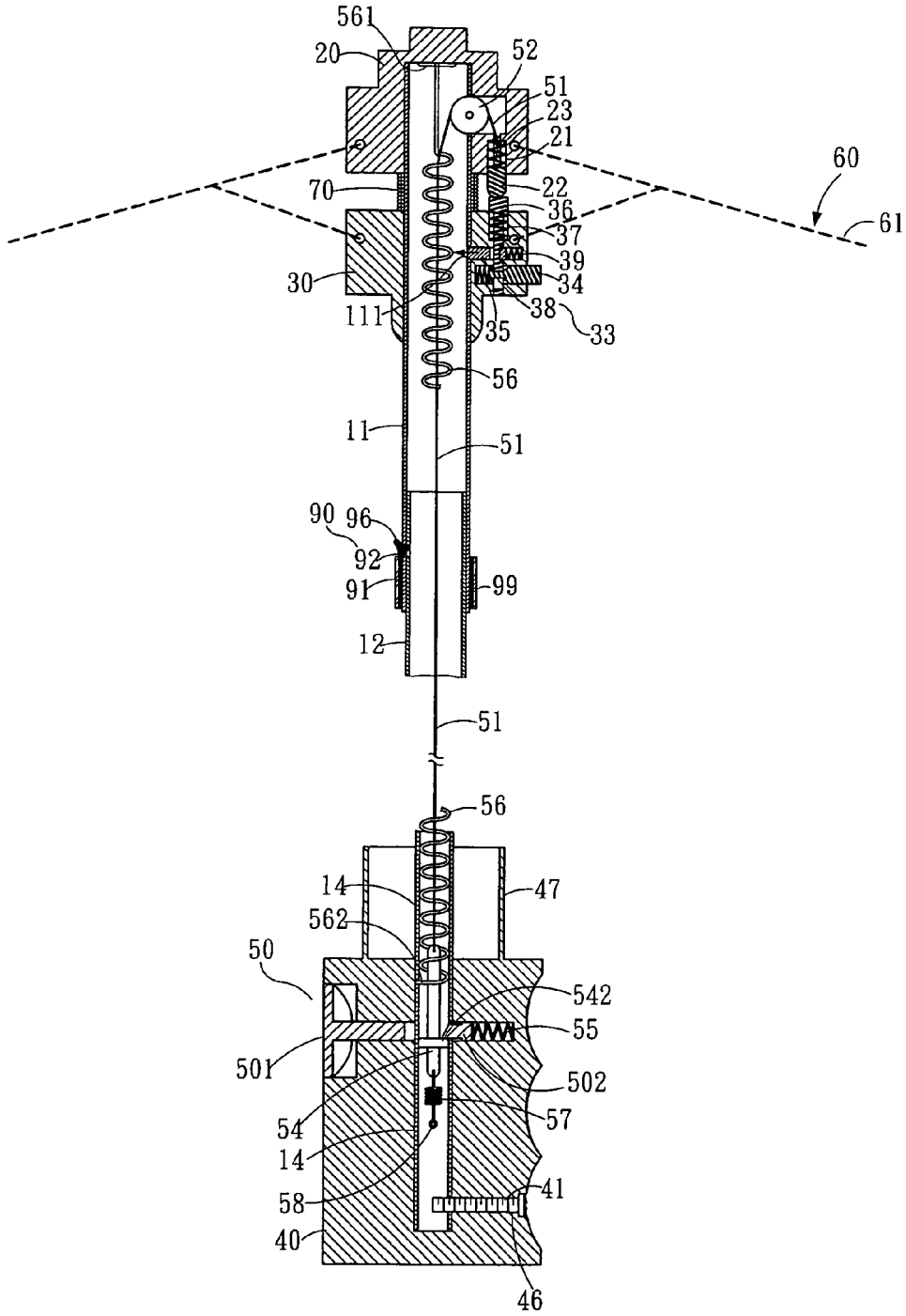
FIG. 6 is a cross section view showing an expanded umbrella.
Figure 7:
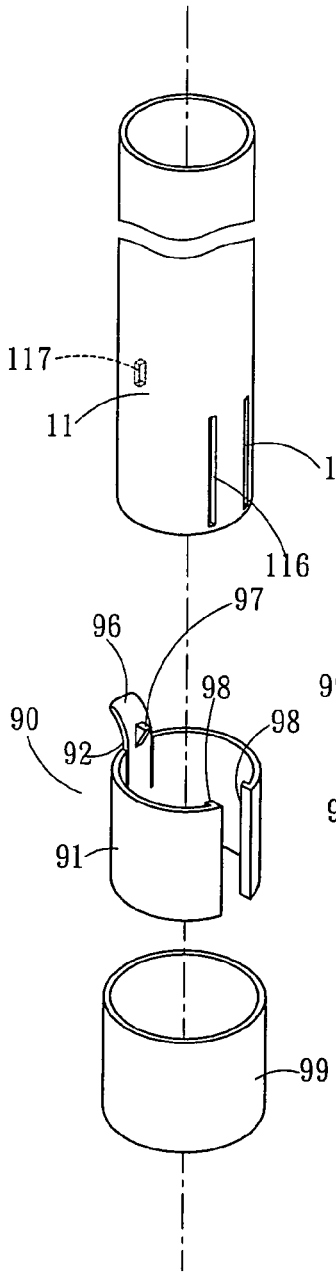
FIG. 7 is an exploded perspective view of the hook device of the present invention.
Figure 8:
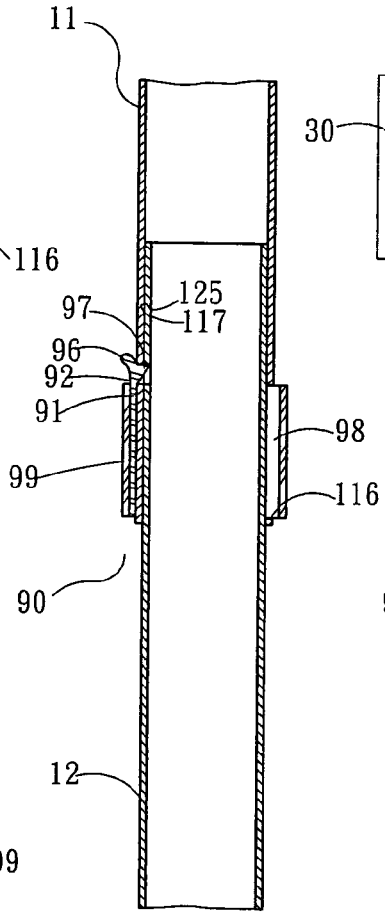
FIG. 8 is a cross section view of the present invention, wherein two central poles of the present invention is placed with a hook device in position.

FIG. 6 shows a sectional view as the umbrella is expanded. Before that, it is understood that the structures of the upper rib collector 20 and lower rib collector 30 have been described in this description. A first elastomer 56 in the central pole 10 is secured to the upper rib collector 20 by an upper end 561 of the first elastomer 56. A lower end 562 of the first elastomer 56 is secured in the lower portion of the handle central pole 14. After each central pole is stretched out, the wire 51 is straight pulled in a vertical direction. The structure of the hook device 90 of each central pole (except the handle central pole 14) as FIG. 7 is shown. In that, an U-type ring 91, an elastic buckling piece 92, an impacting portion 96 at an upper end of the elastic buckling piece, and a buckling hook 97 are combined to form a hook device 90. The U-type ring 91 is set along the outer circle of the lower end of each central pole (for example, upper central pole 11). Two inverted flange 98 at the opening of the U-type ring 91 insert into the corresponding two slits 116 of the central pole 11. To avoid the U-type ring 91 to slide down, a sleeve 99 can be added to enclose the U-type ring 91. Then a buckle hook 97 passes into a hook hole 117 of the upper central pole 11 and then further into a hook hole 125 of the middle central pole 12 so that the upper and middle central poles 11, 12 are combined and thus secured.

Figure 9:
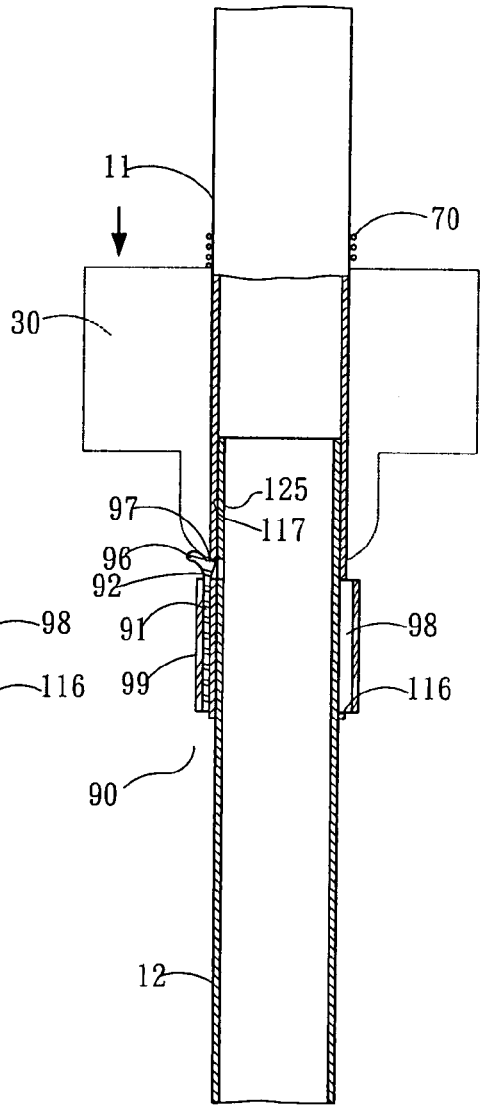
FIG. 9 is a schematic view showing the two central poles are disengaged from the hook device.

FIG. 9 shows that when the umbrella is folded, the lower rib collector 30 will descend due to the expansion of the third elastomer 70. When the lower end contacts the impact portion 96 of the hook device 90. The buckle 92 moves outwards so that the buckle hook 97 will be separated from the hook hole 125 of the middle central pole 12 so that the upper and middle central poles 11, 12 will be disengaged from each other and the upper central pole 11 will descend continuously. Similarly, when the middle central pole 12 descends to touch the hook device 90 of the lower central pole 13, the buckled configuration will be released so that the middle central pole 12 descends continuously. Likewise, finally, the upper, middle, and lower central poles 11-13 will descend to the handle central pole 14 so as to form a telescopic central pole 10 in one section.

Figure 10:
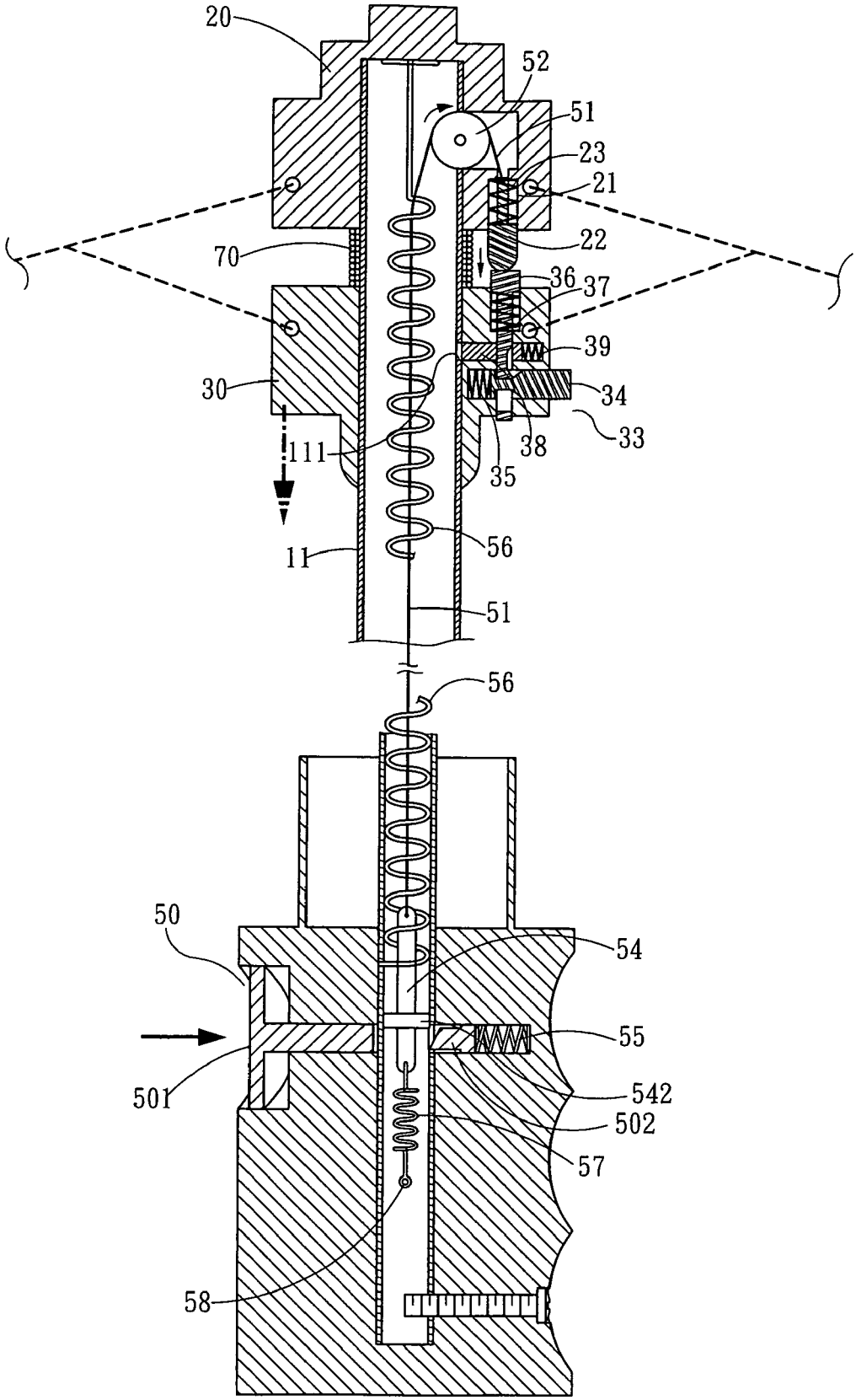
FIG. 10 is a schematic view showing that after the control device is pressed, wherein the lower rib collector is disengaged from the central pole.
Figure 11:
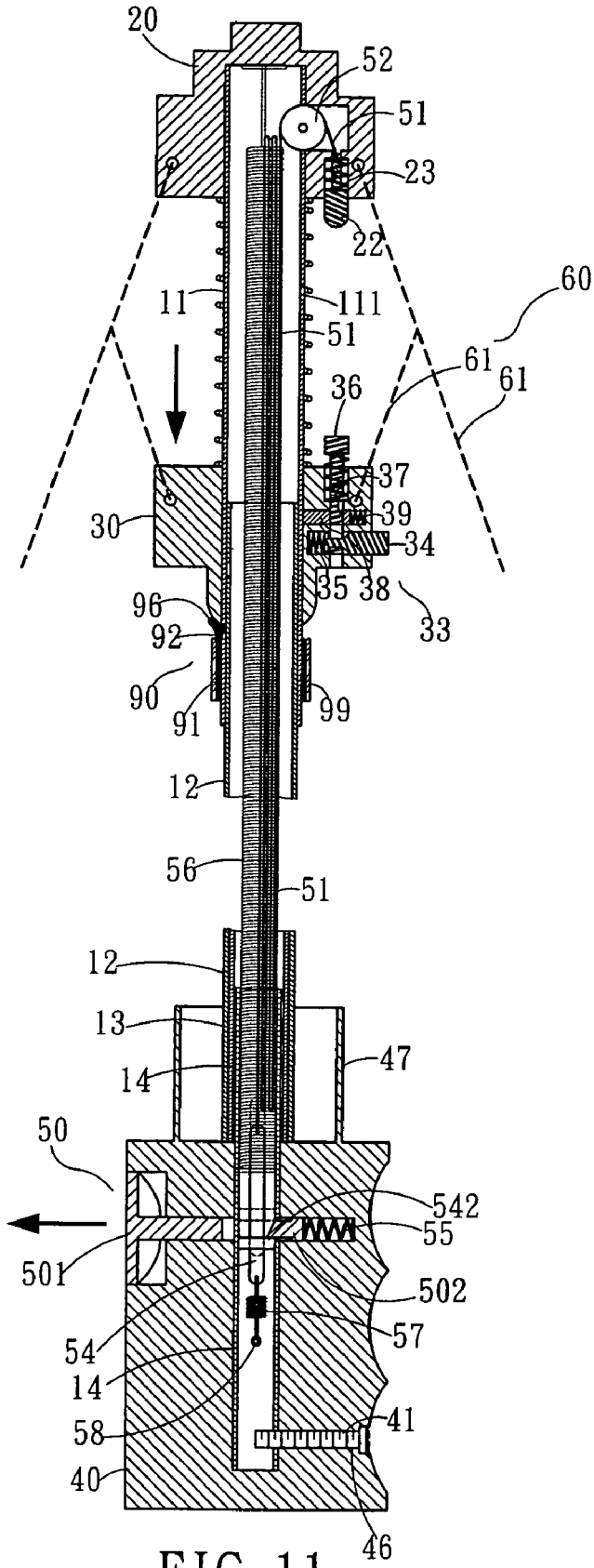
FIG. 11 is a schematic view showing a process next to that of FIG. 10, wherein the folding of the central poles and the canopy are closed.

FIG. 10 is a schematic view showing the umbrella being folded. In the drawing, it is illustrated when the user presses the button 501 on the handle 40 by only one finger, the wire 51 will lift upwards due to the expansion of the elastomer 23 in the upper rib collector 20 so that the key 22 descends. The key 22 further presses the inserting bar 36 so that the inserting bar 36 descends to enforce the positioning pin 38 to retract, and thus is separated from the positioning hole 111 so that the lower rib collector 30 is disengaged from the upper central pole 11. At the same time, the lower rib collector 30 will descend immediately by the expansion of the third elastomer 70. After that, hook devices 90 of each section of central pole can be released and the length of the central pole 10 can be reduced due to the compression of the first elastomer 56, as illustrated in FIG. 11. After central poles are retracted back in a single section, the wire 51 is loose. Therefore, the tenon 54 will descend due to the compression of the second elastomer 57. The bulged rim 542 will slide through the hook 502 to be located therebelow. When the user moves finger in and out a little distance from the button 501, by the expansion of the elastomer 55, the control device 50 will return to the original condition. Moreover, each hinged rib 61 of the umbrella stand 60 will be automatically folded.

Figure 12:
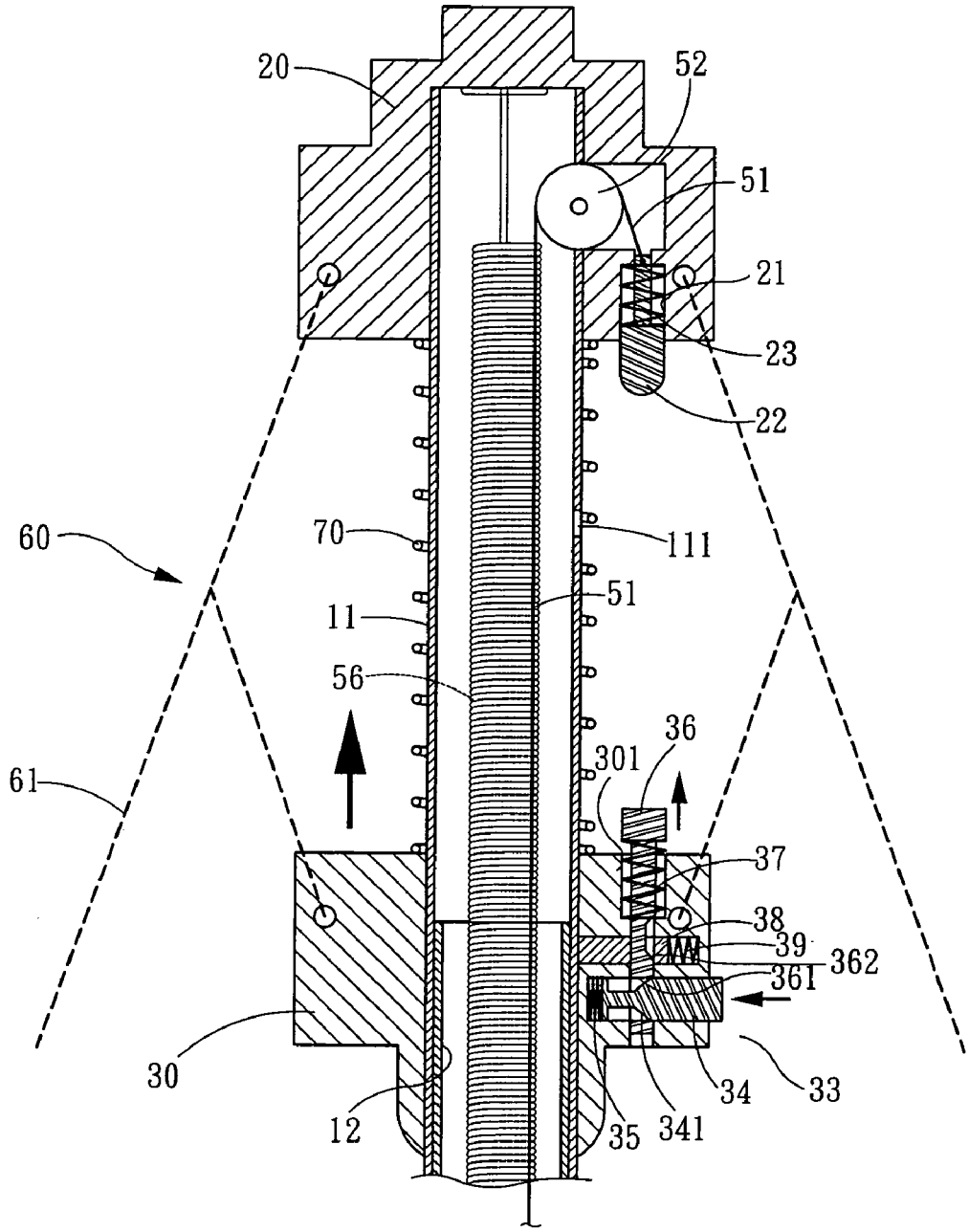
FIG. 12 is a schematic view showing the expansion of the lower rib collector and the central poles in the present invention.

FIG. 12 is a schematic view showing the lower rib collector 30 moving upwards. It is illustrated that after the user pushes the lower rib collector 30 upwards by a single hand. Each hinged rib 61 of the umbrella stand 60 will expand with the lifting of the lower rib collector 30 until the lower rib collector 30 is placed upon the upper central pole 11 in position.

Therefore, by the present invention, the umbrella may fold automatically by using only one hand. Therefore, as the user enters into a house or a car, the user can fold the umbrella by one hand.

What is claimed is:

1. An automatic close umbrella comprising:

a telescopic multi-sectional central pole (10), including an upper central pole, a plurality of intermediate central poles, and a handle central pole disposed at a lower end of the multi-section central pole, each central pole having a hook device (90) for placing each two central poles in position; an upper rib collector (20) secured upon an upper end of the multi-sectional central pole (10); an elastic key (22) being disposed in the upper rib collector (20); the key (22) being connected with one end of a wire (51), another end of the wire (51) being extended and then entering into the multi-sectional central pole (10) and then being connected with a tenon (54) in the handle central pole;

a first elastomer (56) disposed in the multi-section central pole (10) for retracting the central pole (10); one end of the first elastomer (56) being secured to the upper rib collector (20); and another end of the first elastomer (56) being secured to a lower end of the handle central pole (14);

a second elastomer (57) having an end connected with a lower end of the tenon (54) and having another end connected with the handle central pole (14);

a lower rib collector (30) movable along the multi-section central pole (10); a buckle unit (33) being disposed in the lower rib collector (30) which can be pressed by the elastic key (22) for operatively fitting and releasing the lower rib collector on the upper end of the upper central pole;

a third elastomer (70) disposed on an outer circle of the upper central pole (11) and retractable between the upper rib collector (20) and lower rib collector (30);

a handle (40) secured to a lower end of the handle central pole (14);

a control device (50) disposed in the handle and being buckled with the tenon (54);

an umbrella stand (60) formed by a plurality of hinged ribs (61);

and a canopy (62) arranged on the hinged ribs (61); wherein each hook device (90) is an U-type ring (91) having an opening at a ring section and is disposed along a lower end of the central pole;

the opening have inverted flanges (98) on both sides which insert into two corresponding slits (116) of the central pole; the U-type ring (91) has an elastic buckle (92);

an upper end of the elastic buckle (92) has an impact portion (96) with a buckling hook (97);

each central pole has a buckle hole;

and the buckling hook (97) passes through buckling holes of two central poles so as to combine the two central poles.

2. The automatic close umbrella as claimed in claim 1, wherein a sleeve (99) is disposed around the U-type ring (90) for securing the U-type ring (90).

3. The automatic close umbrella as claimed in claim 1, wherein an elastomer (63) is added between the hinged ribs to improve the descending function of the lower rib collector (30) movable along the central pole (10).

4. The automatic close umbrella as claimed in claim 1, wherein the buckle unit (33) includes an inserting bar (36) vertically passes through a straight through hole (301) in the lower rib collector (30); an elastomer (37) in the straight through hole (301) for elastically moving the inserting bar (36); and a positioning pin (38) disposed in a transversal hole (303) of the lower rib collector (30) operated by an elastomer (39).

5. The automatic close umbrella as claimed in claim 1, wherein a pulley (52) is disposed inside the upper rib collector (20) and the upper central pole (11), thereby, the wire (51) is guided into the multi-section central pole (10).

6. The automatic close umbrella as claimed in claim 1, wherein the control device (50) is formed by a girdle (503), a hook (502) disposed inside the rear end of the girdle (503), and a button (501) connected with outside the front end of the girdle, the hook (502) is capable of being buckled to a tenon (54); and the tenon (54) has a bulged rim (542).

* * * * *